US009872595B2

(12) United States Patent
Hansen et al.

(10) Patent No.: US 9,872,595 B2
(45) Date of Patent: Jan. 23, 2018

(54) SURFACE CLEANING APPARATUS WITH HYDROGEN PEROXIDE GENERATOR

(71) Applicants: BISSELL Homecare, Inc., Grand Rapids, MI (US); The Procter & Gamble Company, Cincinnati, OH (US)

(72) Inventors: Eric J. Hansen, Ada, MI (US); Michael T. Dillane, Grand Rapids, MI (US); Juan C. Flores-Escribano, West Chester, OH (US); Jeffrey A. Scholten, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 747 days.

(21) Appl. No.: 14/301,373

(22) Filed: Jun. 11, 2014

(65) Prior Publication Data

US 2014/0359965 A1 Dec. 11, 2014

Related U.S. Application Data

(60) Provisional application No. 61/833,593, filed on Jun. 11, 2013.

(51) Int. Cl.

| | |
|---|---|
| ***A47L 13/22*** | (2006.01) |
| ***A47L 11/40*** | (2006.01) |
| ***B08B 1/00*** | (2006.01) |

(52) U.S. Cl.

CPC ..... *A47L 11/4083* (2013.01); *A47L 11/405* (2013.01); *A47L 11/4086* (2013.01); *A47L 11/4088* (2013.01); *A47L 13/225* (2013.01); *B08B 1/00* (2013.01); *B08B 2230/01* (2013.01); *Y10T 137/0329* (2015.04)

(58) Field of Classification Search

CPC ..... A47L 11/4083; A47L 11/405; A47L 11/4086; A47L 11/4088; A47L 13/225; A47L 11/40; A47L 13/22; B08B 1/00; B08B 2230/01; Y10T 137/0329

See application file for complete search history.

(56) References Cited

U.S. PATENT DOCUMENTS

| | | | |
|---|---|---|---|
| 5,921,251 | A | 7/1999 | Joshi |
| 6,094,767 | A | 8/2000 | Iimura |

(Continued)

FOREIGN PATENT DOCUMENTS

| | | | |
|---|---|---|---|
| EP | 2636353 | A2 | 11/2013 |
| JP | H1057282 | A | 3/1998 |

(Continued)

OTHER PUBLICATIONS

David J. Evans, Search Report under Section 17, Nov. 9, 2015, 1 page, South Wales.

(Continued)

*Primary Examiner* — David Redding
(74) *Attorney, Agent, or Firm* — McGarry Bair PC

(57) ABSTRACT

A surface cleaning apparatus includes a housing with an on-board hydrogen peroxide generator which produces a hydrogen peroxide solution in situ from fluid stored within an on-board supply tank of the surface cleaning apparatus, and further delivers the generated hydrogen peroxide solution to a cleaning pad attached to the housing of the surface cleaning apparatus.

17 Claims, 5 Drawing Sheets

(56) References Cited

U.S. PATENT DOCUMENTS

| | | | | |
|---|---|---|---|---|
| 6,300,299 | B1 | 10/2001 | Murphy et al. | |
| 7,591,043 | B2 | 9/2009 | Ninomiya et al. | |
| 7,819,127 | B1 | 10/2010 | Huffman | |
| 7,891,046 | B2 | 2/2011 | Field et al. | |
| 8,046,867 | B2 | 11/2011 | Field et al. | |
| 2003/0159230 | A1 | 8/2003 | Oh | |
| 2003/0159233 | A1 | 8/2003 | Oh | |
| 2006/0216193 | A1 | 9/2006 | Johnson et al. | |
| 2006/0272120 | A1 | 12/2006 | Barrick et al. | |
| 2007/0094841 | A1 | 5/2007 | Jo | |
| 2009/0074611 | A1 | 3/2009 | Monzyk et al. | |
| 2010/0078318 | A1 | 4/2010 | Huffman | |
| 2012/0096657 | A1 | 4/2012 | So et al. | |
| 2014/0259510 | A1* | 9/2014 | Conrad | A47L 13/225 15/319 |

FOREIGN PATENT DOCUMENTS

| | | | |
|---|---|---|---|
| JP | 2005131240 | A | 5/2005 |
| JP | 2009240602 | A | 10/2009 |
| WO | 2002078504 | A1 | 10/2002 |
| WO | 2009152149 | A2 | 12/2009 |
| WO | 2014087925 | A1 | 6/2014 |
| WO | 20150125739 | A1 | 8/2015 |

OTHER PUBLICATIONS

Rhodri Evans, Search Report Under Section 17(5), 4 pages, dated Oct. 29, 2014, Intellectual Propery Office, South Wales.

* cited by examiner

SURFACE CLEANING APPARATUS WITH HYDROGEN PEROXIDE GENERATOR

CROSS-REFERENCE TO RELATED APPLICATION

This application claims the benefit of U.S. Provisional Patent Application No. 61/833,593, filed Jun. 11, 2013, which is incorporated herein by reference in its entirety.

BACKGROUND OF THE INVENTION

Surface cleaning apparatuses, such as steam mops and hand-held steamers are configured for cleaning a wide variety of common household surfaces such as bare flooring, including tile, hardwood, laminate, vinyl, and linoleum, as well as carpets, rugs, countertops, stove tops and the like. Typically, steam mops have at least one liquid tank or reservoir for storing a liquid, generally water, which is fluidly connected to a steam generator via a flow control mechanism, such as a pump or valve. The steam generator includes a heater for heating the liquid to produce steam, which can be directed towards the surface to be cleaned through a steam outlet, typically located in a foot or cleaning head that engages the surface to be cleaned during use. The steam is typically applied to one side of a cleaning pad that is attached to the cleaning head, with the opposite side used to wipe the surface to be cleaned. The steam saturates the cleaning pad, and the damp cleaning pad is wiped across the surface to be cleaned to remove dirt, debris, and other soils present on the surface.

BRIEF DESCRIPTION OF THE INVENTION

In one aspect, the invention relates to a surface cleaning apparatus including a housing adapted to be moved across a surface to be cleaned, a cleaning pad attached to an underside of the housing, a fluid supply tank, and a hydrogen peroxide generator provided with the housing in fluid communication with the supply tank. The hydrogen peroxide generator includes a catalyst surface, a fluid distributor configured to deliver fluid from the supply tank to the catalyst surface, and an ultraviolet light source configured to emit ultraviolet light directly onto the catalyst surface, wherein the exposure of fluid on the catalyst surface to ultraviolet light emitted by the ultraviolet light source produces a hydrogen peroxide solution that is delivered to the cleaning pad.

In another aspect, the invention relates to a method of delivering a cleaning solution to a cleaning pad attached to a surface cleaning apparatus. The method includes generating a hydrogen peroxide solution on-board the surface cleaning apparatus, and providing the generated hydrogen peroxide solution to the cleaning pad.

BRIEF DESCRIPTION OF THE DRAWING(S)

Figure 2:
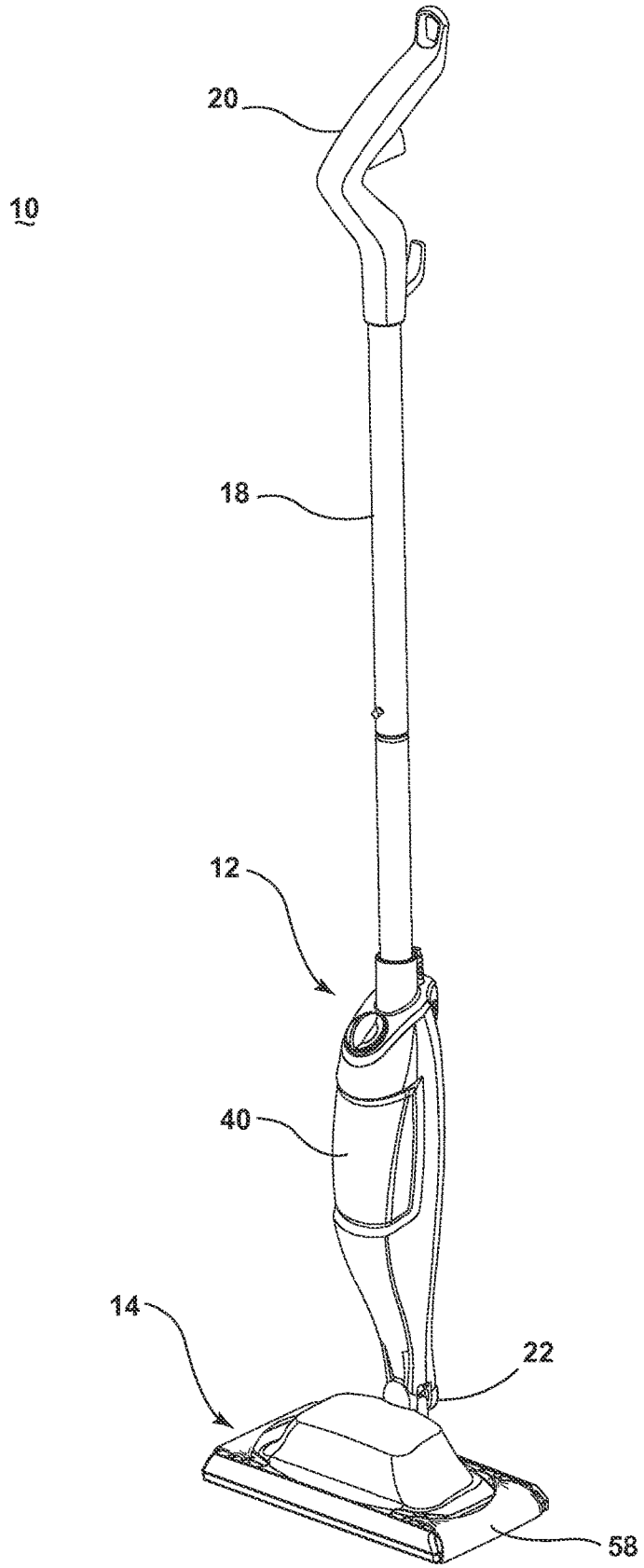
FIG. 2 is a front perspective view of a surface cleaning apparatus in the form of a steam mop according to a second embodiment of the invention.
Figure 4:
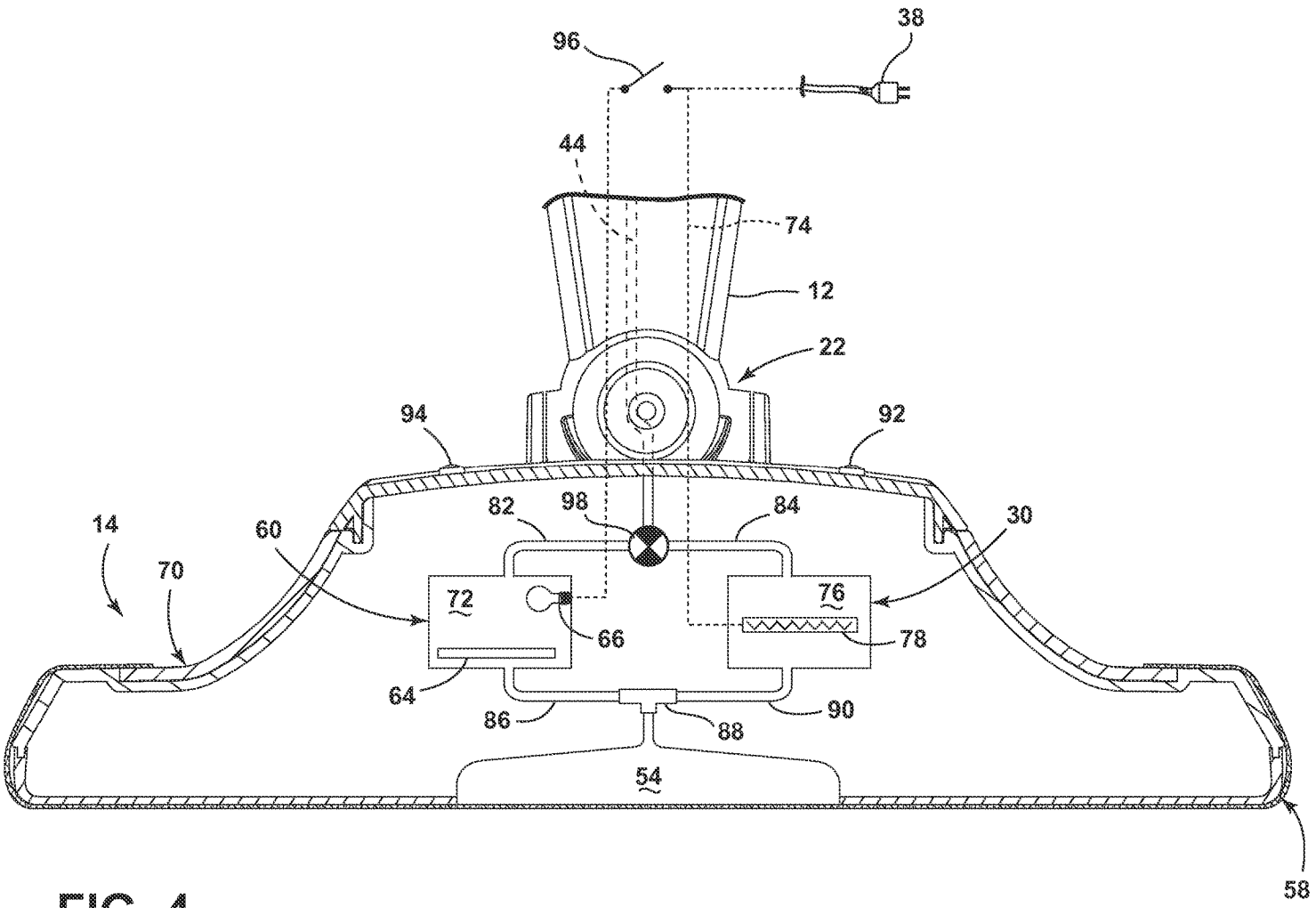
Figure 5:
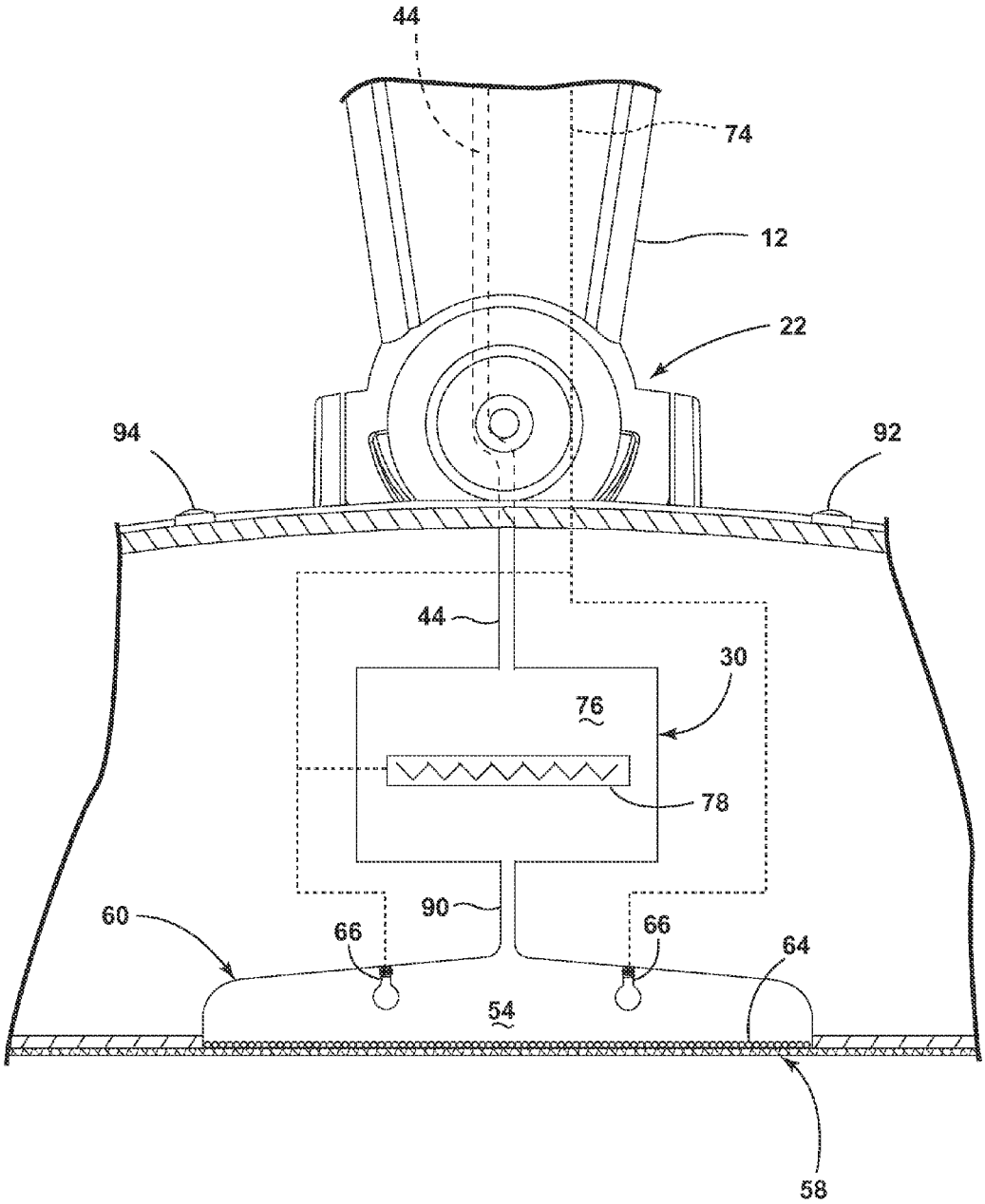

FIG. 4 is a schematic view of a foot 14 that can be used with the steam mop 10 of FIG. 2 in accordance with a third embodiment of the invention; and FIG. 5 is a schematic view of a foot 14 that can be used with the steam mop 10 of FIG. 2 in accordance with a fourth embodiment of the invention.

DETAILED DESCRIPTION OF THE INVENTION

Figure 1:
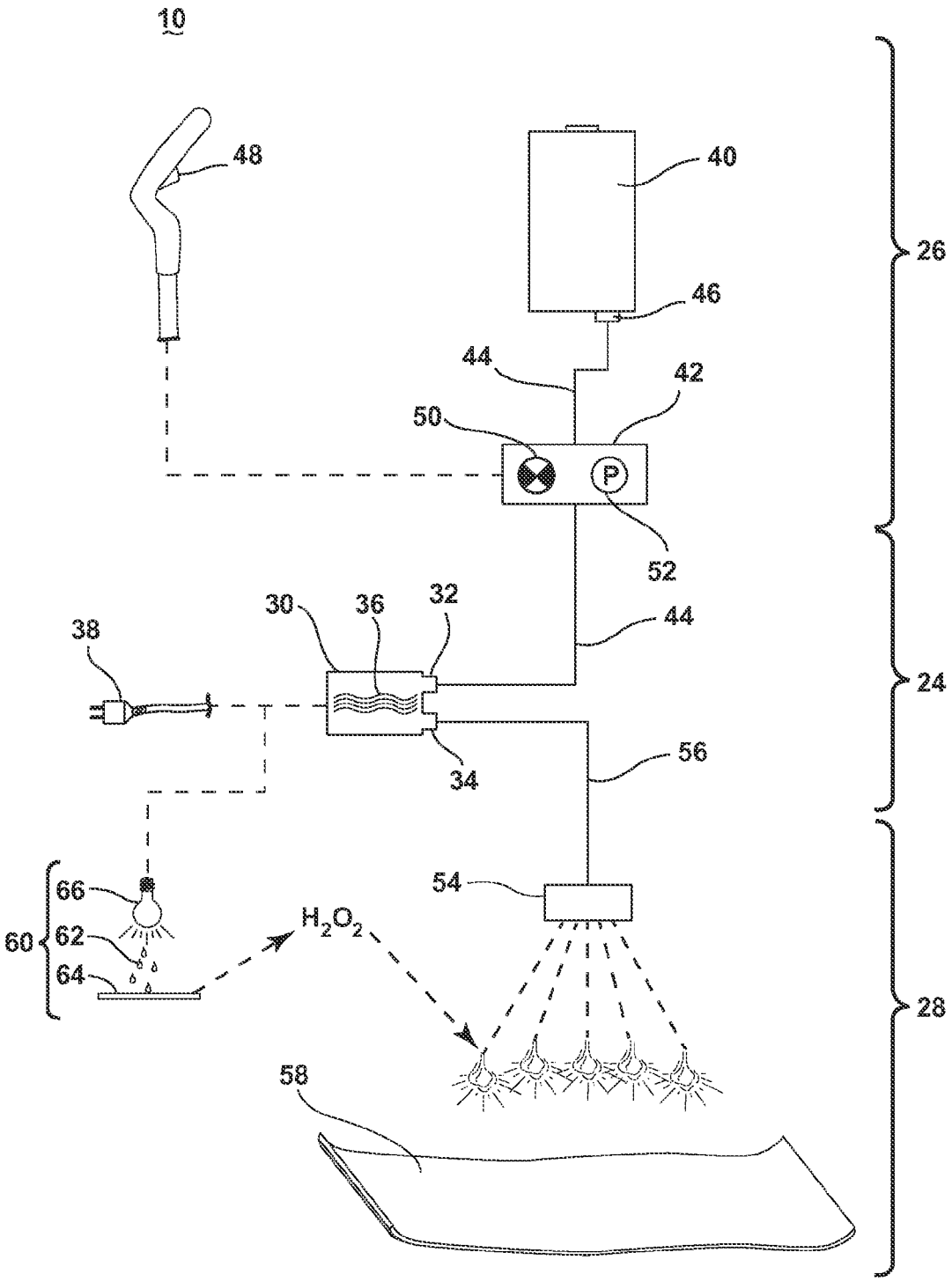
FIG. 1 is a schematic view of a surface cleaning apparatus according to a first embodiment of the invention.

FIG. 1 is a schematic view of various functional systems of a surface cleaning apparatus in the form of a steam mop 10 according to a first embodiment of the invention. While referred to herein as a steam mop 10, the surface cleaning apparatus can alternatively be configured as a hand-held steam applicator device, or as an apparatus having a hand-held accessory tool connected to a canister or other portable device by a steam distribution hose. Additionally, the surface cleaning apparatus can be configured to distribute liquid rather than steam, and/or can additionally have agitation capability, including scrubbing and/or sweeping, vacuuming capability, and/or extraction capability.

The steam mop 10 includes a steam generation system 24 for producing steam from liquid, a liquid distribution system 26 for storing liquid and delivering the liquid to the steam generation system 24, and a steam delivery system 28 for delivering steam to a surface to be cleaned.

The steam generation system 24 can include a steam generator 30 producing steam from liquid. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The liquid distribution system 26 can include at least one supply tank 40 for storing a supply of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent. The liquid distribution system 26 can further include multiple supply tanks, such as one tank containing water and another tank containing a cleaning agent.

The liquid distribution system 26 can comprise a flow controller 42 for controlling the flow of liquid through a fluid conduit 44 coupled between an outlet port 46 of the supply tank 40 and the inlet 32 of the steam generator 30. An actuator 48 can be provided to actuate the flow controller 42 and dispense liquid to the steam generator 30.

In one configuration, the liquid distribution system 26 can comprise a gravity-feed system and the flow controller 42 can comprise a valve 50, whereby when valve 50 is open, liquid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing electrical switch between the valve 50 and the power source 38 that is selectively closed when the actuator 48 is actuated, thereby powering the valve 50 to move to an open position.

In another configuration, the flow controller 42 can comprise a pump 52 which distributes liquid from the supply tank 40 to the steam generator 30. The actuator 48 can be operably coupled to the pump 52 such that pressing the actuator 48 will activate the pump 52. The pump 52 can be electrically actuated, such as by providing electrical switch between the pump 52 and the power source 38 that is selectively closed when the actuator 48 is actuated, thereby activating the pump 52.

The steam delivery system 28 can include at least one steam outlet 54 for delivering steam to the surface to be cleaned, and a fluid conduit 56 coupled between an outlet 34 of the steam generator 30 and the at least one steam outlet 54. The at least one steam outlet 54 can comprise any structure, such as a perforated manifold or at least one nozzle; multiple steam outlets can also be provided. In use, the generated steam is pushed out of the outlet 34 of the steam generator 30 by pressure generated within the steam generator 30 and, optionally, by pressure generated by the pump 52 or a separate fan (not shown). The steam flows through the fluid conduit 56, and out of the at least one steam outlet 54.

A cleaning pad 58 can be removably attached over the steam outlet 54 to the steam mop 10. In use, the cleaning pad 58 is saturated by the steam from the steam outlet 54, and the damp cleaning pad 58 is wiped across the surface to be cleaned to remove dirt present on the surface. The cleaning pad 58 can be provided with features that enhance the scrubbing action on the surface to be cleaned to help loosen dirt on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The steam mop 10 further comprises an on-board hydrogen peroxide generator 60 which produces a reactive oxygen species, hydrogen peroxide, in situ from water stored on the steam mop 10. The generated hydrogen peroxide is then applied to a surface to be cleaned. In particular, the cleaning pad 58 can be used to apply the peroxide, as well as any additional reactive oxygen species which may be generated from the hydrogen peroxide, to organic stains and/or dye-based stains on the surface. The hydrogen peroxide and other reactive oxygen species, can oxidize organic compounds and in some cases completely oxidize the organic compounds to carbon dioxide and water, and can also react with stains having an unstable bond structure (for example, double bonded carbons), including both visible stains and odors.

The hydrogen peroxide generator 60 includes a water source 62, which can be stored on the steam mop 10, at least one catalyst surface 64, such as a titanium dioxide ($TiO_2$) catalyst, and at least one ultraviolet (UV) light source 66. The UV light source 66 emits UV light onto the $TiO_2$ surface 64 which, in the presence of water, acts as a catalyst under the UV light for the oxidation reaction between the water and oxygen ($O_2$). Water can be supplied to the $TiO_2$ surface 64 in the form of liquid or steam. When the $TiO_2$ surface 64 absorbs UV light in the presence of water molecules ($H_2O$) and oxygen ($O_2$), the water molecules ($H_2O$) are converted into hydrogen peroxide ($H_2O_2$) per the following reaction:

$$2H_2O+O_2 \rightarrow 2H_2O_2$$

The generated hydrogen peroxide may be in the form of a liquid, or a mixture of liquid and vapor forms, and can be delivered to the cleaning pad 58 or directly to the surface to be cleaned. While the water source 62 may periodically require replenishment, the $TiO_2$ surface 64 remains unchanged by the reaction, and so does not require replacement or replenishment.

The UV light source 66 can output a beam of UV light in the range of 1-100 watts to achieve a high energy output at a frequency in the UVC range, (100-280 nm) in order to generate an effective amount of hydrogen peroxide. The UV light source 66 can be electrically coupled to the power source 38 or to its own dedicated power source.

The hydrogen peroxide generator 60 can be integrated with one or more of the steam generation system 24, liquid distribution system 26, and steam delivery system 28. For example, the water source 62 can comprise the supply tank 40 and the generated hydrogen peroxide can be directed through the steam outlet 54, such that the hydrogen peroxide co-mingles with generated steam before being delivered to the cleaning pad 58. Alternatively, the hydrogen peroxide generator 60 can be a separate system, with a dedicated water source 62 and delivery outlet.

The steam mop 10 shown in FIG. 1 can be used to effectively generate hydrogen peroxide to remove stains and odors from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

The cleaning pad 58 is attached to the steam mop 10, over the steam outlet 54, the supply tank 40 is filled with liquid, and the steam generator 30 and UV light source 66 are coupled to the power source 38. Upon actuation of the actuator 48, liquid flows to the steam generator 30 and is heated to its boiling point to produce steam. Liquid also flows to the hydrogen peroxide generator 60 and is converted to hydrogen peroxide. The steam and hydrogen peroxide are passed through the cleaning pad 58. As steam passes through the cleaning pad 58, a portion of the steam may return to liquid form before reaching the floor surface. The steam delivered to the floor surface also returns to liquid form. As the damp cleaning pad 58 is wiped over the surface to be cleaned, excess liquid and dirt on the surface is absorbed by the cleaning pad 58.

The cleaning pad 58 can further be provided with a cleaning agent or composition that can react with the hydrogen peroxide to further enhance cleaning and/or the decomposition of organic compounds. In one example, the cleaning pad 58 is provided with an iron catalyst that will oxidize in the presence of hydrogen peroxide in a Fenton reaction as follows to form additional active oxygen species, such as a hydroxyl radical and a perhydroxyl radical, which can oxidize organic compounds:

$$Fe^{2+}+H_2O_2 \rightarrow Fe^{3+}+OH.+OH^-$$

$$Fe^{3+}+H_2O_2 \rightarrow Fe^{2+}+.OOH+H^+$$

FIG. 2 is a front perspective view of a surface cleaning apparatus in the form of a steam mop 10 according to a second embodiment of the invention. For purposes of description related to the figures, the terms "upper," "lower," "right," "left," "rear," "front," "vertical," "horizontal," "inner," "outer," and derivatives thereof shall relate to the invention as oriented in FIG. 2 from the perspective of a user behind the steam mop 10, which defines the rear of the steam mop 10. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The steam mop 10 comprises a upper housing 12 mounted to a lower cleaning foot 14 which is adapted to be moved across a surface to be cleaned. The housing 12 and the foot 14 may each support one or more components of the various functional systems discussed with respect to FIG. 1. An elongated handle 18 can project from the housing 12, with a handle grip 20 provided on the end of the handle 18 to facilitate movement of the steam mop 10 by a user. A coupling joint 22 is formed at an opposite end of the housing 12 and moveably mounts the foot 14 to the housing 12. In the embodiment shown herein, the coupling joint 22 can comprise a universal joint, such that the foot 14 can pivot about at least two axes relative to the housing 12.

Figure 3:
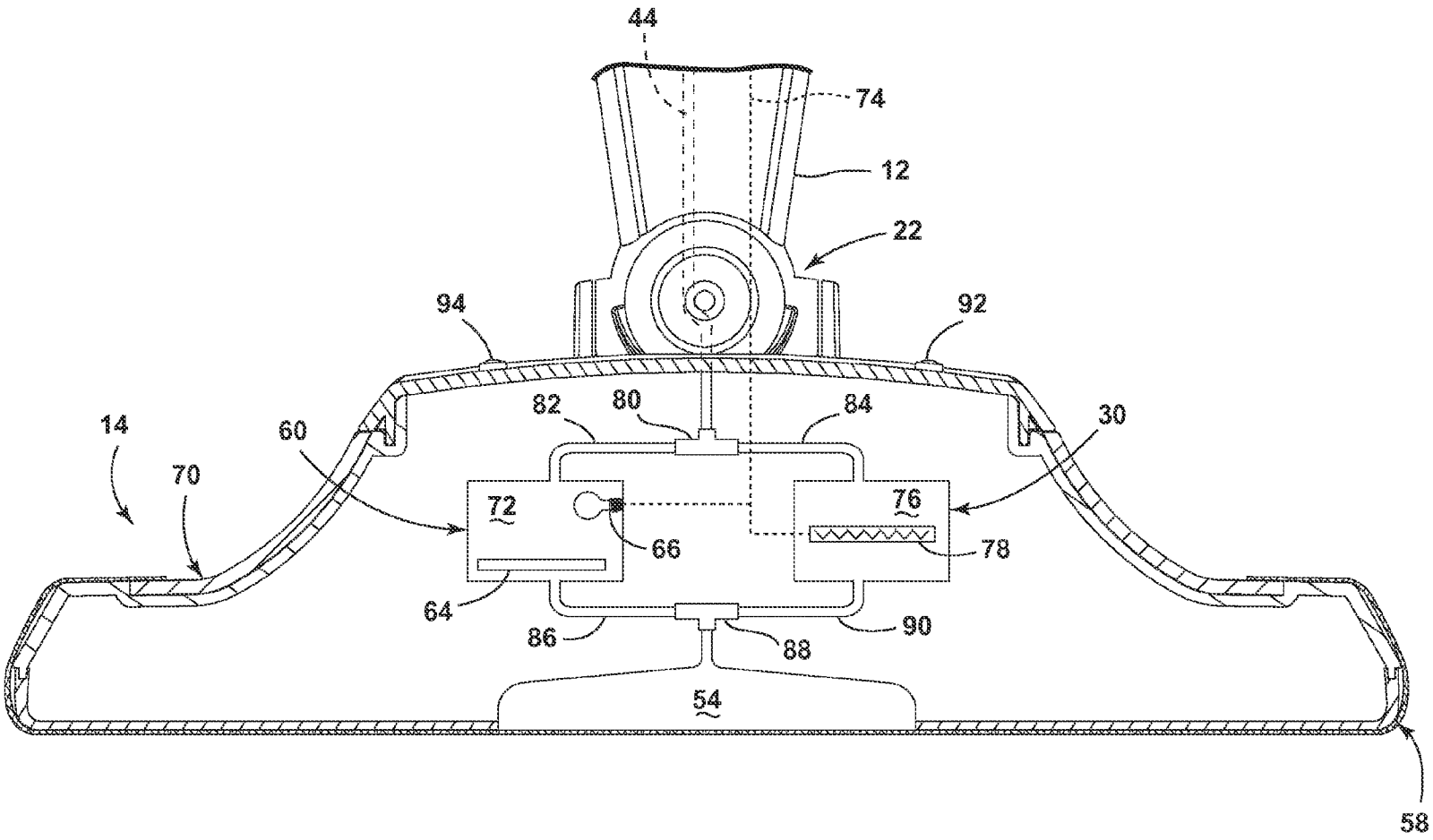
FIG. 3 is a schematic view of a foot assembly for the steam mop of FIG. 2.

FIG. 3 is a schematic view of the foot 14 from FIG. 2. The foot 14 can comprise a housing 70 adapted to be moved over the surface to be cleaned and which carries the steam generator 30 and hydrogen peroxide generator 60, and can mount the cleaning pad 58.

The hydrogen peroxide generator 60 includes a cavity 72 defined within the housing 70 in which the $TiO_2$ surface 64 and UV light source 66 are located. The UV light source 66 can be in the form of a UV light bulb which emits UV light toward the $TiO_2$ surface 64 and which can be coupled with the power source 38 via an electrical conductor 74 that extends through the coupling joint 22.

The steam generator 30 can comprise a flash heater having a cavity 76 defined within the housing 70 and an electrical heating element 78 mounted within the cavity 76 which can be coupled with the power source 38 via the electrical conductor 74. The heating element 78 is configured to flash heat the liquid and convert the liquid into steam. A thermostat (not shown) can be connected to the heating element 78 and adapted to regulate the operational temperature of the heating element 78 based on a desired performance criteria. For example, the thermostat can regulate the operational temperature to match the boiling point of the liquid to be converted to steam.

The fluid conduit 44 can extend through the coupling joint 22 and can comprise flexible tubing that bends with the movement of the handle 18. In one configuration, the fluid conduit 44 can comprise flexible silicone, polyurethane or polyvinyl chloride tubing, for example. Within the foot 14, the fluid conduit 44 can branch into a first inlet conduit 82 supplying liquid to the hydrogen peroxide generator 60 and a second inlet conduit 84 supplying liquid to the steam generator 30 at a first conduit tee 80.

Liquid enters the cavity 72 of the hydrogen peroxide generator 60 via the inlet conduit 82, falls on the $TiO_2$ surface 64, and is exposed to UV light from the UV light source 66. The inlet conduit 82 can include an orifice restrictor (not shown) for limiting the flow rate of liquid into the cavity 72 to achieve a drip-type dispersion of liquid onto the $TiO_2$ surface 64. An outlet conduit 86 of the hydrogen peroxide generator 60 extends from the cavity 72 to a second conduit tee 88.

Liquid from the conduit tee 80 also travels to the heating element 78 via inlet conduit 84 where the liquid falls on the heating element 78 located in cavity 76 of the steam generator. The inlet conduit 84 can include an orifice restrictor (not shown) for limiting the flow rate of liquid into the cavity 76 of the flash heater to achieve a drip-type dispersion of liquid onto the heating element. An outlet conduit 90 of the steam generator 30 extends from the cavity 76 to the second conduit tee 88.

At the second conduit tee 88, the generated hydrogen peroxide can comingle with the generated steam, and an $H_2O_2$-infused steam can applied to the cleaning pad 58 via the steam outlet 54, which can be provided on the underside of the housing 70.

The steam mop 10 can be provided with visual indicia 92, 94 to give the user an indication of the functional status of the steam generator 30 and/or hydrogen peroxide generator 60. For example, a first light 92 can be configured to illuminate when the steam generator 30 has reached the threshold operational temperature for generating steam and a second light 94 can be configured to illuminate when the hydrogen peroxide generator 60 is producing hydrogen peroxide. In one configuration, the first light 92 can be electrically coupled with the thermostat (not shown) and is configured to illuminate only after the steam generator 30 reaches a predetermined operating temperature as determined by the thermostat and the second light 94 can be configured to illuminate when the UV light source 66 is on. In another configuration (not shown), the steam indicia 92 can comprise a vent that distributes a portion of the steam above the foot 14 so that some steam is visible to the user and the peroxide indicia 94 can comprise a light port which distributes a portion of the UV light from the light source 66 to the top of the foot 14 so that some UV light is visible to the user. In yet another configuration (not shown), the peroxide indicia 94 can comprise a viewing port on the housing 70 that allows a section of the cleaning pad 58 to be seen. The section of the cleaning pad 58 can contain a chemical which reacts with hydrogen peroxide to create an observable result, such as a color change or bubbles that can be in the form of fizzing.

The steam mop 10 shown in FIGS. 2-3 can be used to effectively generate hydrogen peroxide to remove stains and odors from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the cleaning pad 58 is attached to the foot 14, the supply tank 40 is filled with liquid, and the power cord 38 is plugged into a household electrical outlet. Upon pressing the actuator 48, liquid flows from the supply tank 40 to the steam generator 30 and the hydrogen peroxide generator 60. In the steam generator 30, liquid is heated to its boiling point to produce steam by flashing off the heating element 78, while within the hydrogen peroxide generator 60 the liquid is exposed to UV light and a $TiO_2$ catalyst to produce hydrogen peroxide. The generated steam mixes with the generated hydrogen peroxide at the second conduit tee 88 and the $H_2O_2$-infused steam is pushed out from the steam outlet 54 towards the surface to be cleaned. As the $H_2O_2$-infused steam passes through the cleaning pad 58, a portion of the steam may return to liquid form before reaching the floor surface. The steam delivered to the floor surface also returns to liquid form. As the damp cleaning pad 58 is wiped over the surface to be cleaned, excess liquid and dirt on the surface is absorbed by the cleaning pad 58.

FIG. 4 is a schematic view of a foot 14 that can be used with the steam mop 10 of FIG. 2 in accordance with a third embodiment of the invention. In this embodiment, a separate switch 96 can be provided to selectively turn on the UV light source 66, such that a user can control the operation of the hydrogen peroxide generator 60 independently of the operation of the steam generator 30. In one example, the switch 96 can comprise a rheostat to control the amount of UV light applied to the $TiO_2$ surface 64, which indirectly controls the rate of hydrogen peroxide production. In this example, a user of the steam mop 10 can select the intensity of UV light emitted by the UV light source 66 depending on the type of stain to be removed from a surface. Optionally, a valve 98 can be provided instead of the first conduit tee 80 for selectively directing all liquid to the steam generator 30 or dividing the liquid between the steam generator 30 and the hydrogen peroxide generator 60, and can be coupled with the switch 96 such that the valve 98 opens to supply a portion of the liquid to the hydrogen peroxide generator 60 when the switch 96 closes to turn on the UV light source 66.

FIG. 5 is a schematic view of a foot 14 that can be used with the steam mop 10 of FIG. 2 in accordance with a fourth embodiment of the invention. In this embodiment, a $TiO_2$ catalyst is applied to or otherwise incorporated with the cleaning pad 58 such that the top or inner side of the cleaning pad 58 (i.e. the side facing the foot 14) serves as the $TiO_2$ surface 64 for the hydrogen peroxide generator 60. The UV light source 66 is located on the bottom of the foot 14 and shines UV light onto the cleaning pad 58. As steam is applied to the cleaning pad 58 from the steam outlet 54, at least some of the water molecules are oxidized into hydrogen peroxide. The generated hydrogen peroxide comingles with the steam and an $H_2O_2$-infused steam is applied to the surface to be cleaned by the cleaning pad 58.

The surface cleaning apparatus disclosed herein provides an improved cleaning operation. One advantage that may be realized in the practice of some embodiments of the described surface cleaning apparatus is that hydrogen peroxide can be produced in situ from water stored on the steam mop 10. Previous attempts have been made to generate hydrogen peroxide directly on the surface to be cleaned. However, this requires pre-treating the surface with titanium dioxide ($TiO_2$) and then adding water and UV light to the treated surface. If any $TiO_2$ remains on the surface after a cleaning operation, these residual amounts $TiO_2$ left can change the appearance and feel of the surface.

Another advantage that may be realized in the practice of some embodiments of the described surface cleaning apparatus is that hydrogen peroxide can be easily produced from a consumable (water) that is readily available in user's homes. This obviates the need for the user to purchase, store, and load a consumable hydrogen peroxide. Furthermore, a single tank can be used to on a surface cleaning apparatus that provides multiple treating chemistries to the surface; specifically, the tank can store water which can be applied to the surface to be cleaned as liquid or steam, or be converted into hydrogen peroxide.

The surface cleaning apparatus described herein avoids these issues by conducting the reaction on board, and confines the $TiO_2$ to locations which do not directly contact the surface to be cleaned. The generated hydrogen peroxide can remove organic stains, dye-based stains, and odors from the surface. The application of steam along with the hydrogen peroxide is also beneficial since steam can successfully treat other types of stains which hydrogen peroxide may miss. However, while providing the hydrogen peroxide generator 60 on a steam mop 10 may offer a more comprehensive cleaning performance since the steam can treat other types of stains that hydrogen peroxide does not, for some applications the surface cleaning apparatus need only distribute hydrogen peroxide to the surface to be cleaned. For example, the hydrogen peroxide generator 60 can be provided on a Swiffer® Wet Jet or other liquid-distributing floor mop.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus comprising:
- a housing adapted to be moved across a surface to be cleaned;
- a cleaning pad attached to an underside of the housing;
- a fluid supply tank; and
- a hydrogen peroxide generator provided with the housing in fluid communication with the supply tank, the hydrogen peroxide generator comprising:
  - a catalyst surface;
  - a fluid distributor configured to deliver fluid from the supply tank to the catalyst surface; and
  - an ultraviolet light source configured to emit ultraviolet light directly onto the catalyst surface;
- wherein the exposure of fluid on the catalyst surface to ultraviolet light emitted by the ultraviolet light source produces a hydrogen peroxide solution that is delivered to the cleaning pad; and
- wherein the cleaning pad is provided with an agent reactive with hydrogen peroxide.

2. The surface cleaning apparatus of claim 1, wherein the housing comprises a lower housing moveably coupled with an upper housing having a handle, and wherein the cleaning pad is attached to the lower housing.

3. The surface cleaning apparatus of claim 1, wherein the surface cleaning apparatus comprises a steam generator.

4. The surface cleaning apparatus of claim 3, and further comprising at least one steam outlet provided in the housing for delivering steam to the cleaning pad.

5. The surface cleaning apparatus of claim 4, wherein the at least one steam outlet is further fluidly coupled with the hydrogen peroxide generator such that the steam co-mingles with the hydrogen peroxide solution before being delivered to the cleaning pad.

6. The surface cleaning apparatus of claim 4, wherein the hydrogen peroxide generator includes a first cavity defined within the housing in which the catalyst surface and the ultraviolet light source are located.

7. The surface cleaning apparatus of claim 6, wherein the steam generator includes a second cavity defined within the housing and comprises a heating element mounted within the second cavity.

8. The surface cleaning apparatus of claim 7, wherein the first and second cavities are in fluid communication with the supply tank, such that the first and second cavities are supplied with fluid from the supply tank.

9. The surface cleaning apparatus of claim 8, and further comprising a valve for selectively controlling the supply of fluid from the supply tank to one of the first and second cavities.

10. The surface cleaning apparatus of claim 8, wherein the first and second cavities are in fluid communication with the at least one steam outlet.

11. The surface cleaning apparatus of claim 1, wherein the agent comprises an iron catalyst.

12. A surface cleaning apparatus comprising:

a housing adapted to be moved across a surface to be cleaned;

a cleaning pad attached to an underside of the housing;

a fluid supply tank; and a hydrogen peroxide generator provided with the housing in fluid communication with the supply tank, the hydrogen peroxide generator comprising:

a catalyst surface;

a fluid distributor configured to deliver fluid from the supply tank to the catalyst surface; and an ultraviolet light source configured to emit ultraviolet light directly onto the catalyst surface;

wherein the exposure of fluid on the catalyst surface to ultraviolet light emitted by the ultraviolet light source produces a hydrogen peroxide solution that is delivered to the cleaning pad; and wherein the catalyst surface is provided on the cleaning pad.

13. The surface cleaning apparatus of claim 1, wherein the catalyst surface is a titanium dioxide surface.

14. The surface cleaning apparatus of claim 12, wherein the housing comprises a lower housing moveably coupled with an upper housing having a handle, and wherein the cleaning pad is attached to the lower housing.

15. The surface cleaning apparatus of claim 12, wherein the surface cleaning apparatus comprises a steam generator.

16. The surface cleaning apparatus of claim 15, and further comprising at least one steam outlet provided in the housing for delivering steam to the cleaning pad.

17. The surface cleaning apparatus of claim 12, wherein the catalyst surface is a titanium dioxide surface.

* * * * *